US007150174B2

(12) United States Patent
Claydon

(10) Patent No.: US 7,150,174 B2
(45) Date of Patent: Dec. 19, 2006

(54) REFORM ROLLERS

(75) Inventor: Paul Charles Claydon, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 26 days.

(21) Appl. No.: 10/518,093

(22) PCT Filed: Jun. 13, 2003

(86) PCT No.: PCT/EP03/06239

§ 371 (c)(1),
(2), (4) Date: Dec. 16, 2004

(87) PCT Pub. No.: WO04/000481

PCT Pub. Date: Dec. 31, 2003

(65) Prior Publication Data

US 2005/0229665 A1 Oct. 20, 2005

(30) Foreign Application Priority Data

Jun. 21, 2002 (EP) ..... 02254347

(51) Int. Cl.
*B21D 1/02* (2006.01)

(52) U.S. Cl. ..... 72/112; 72/102

(58) Field of Classification Search ..... 72/53, 72/102, 110, 112, 120, 199, 703; 451/28
See application file for complete search history.

(56) References Cited

U.S. PATENT DOCUMENTS

| | | | | |
|---|---|---|---|---|
| 3,017,697 | A * | 1/1962 | Wlodek | 72/377 |
| 5,105,586 | A * | 4/1992 | Jenne et al. | 51/293 |
| 5,222,385 | A * | 6/1993 | Halasz et al. | 72/117 |
| 5,789,066 | A * | 8/1998 | De Mare et al. | 428/156 |
| 5,934,127 | A | 8/1999 | Ihly | |
| 6,217,811 | B1 | 4/2001 | Mirtsch et al. | |
| 6,442,988 | B1 * | 9/2002 | Hamstra et al. | 72/96 |
| 2002/0115382 | A1 * | 8/2002 | Luthy | 451/28 |

FOREIGN PATENT DOCUMENTS

EP 0482586 A1 4/1992

* cited by examiner

*Primary Examiner*—Ed Tolan
(74) *Attorney, Agent, or Firm*—Diller, Ramik & Wight

(57) ABSTRACT

Reform rollers for use in internal or external base reforming of can bodies have a textured surface which control the depth of the dome of the can base and provide greater process stability than is achieved with known smooth rollers. One example of textured surface finish provided by spark erosion has been shown to have much greater consistency of dome reversal pressure, dome growth and dome depth.

12 Claims, 5 Drawing Sheets

REFORM ROLLERS

This application is a 35 U.S.C. 371 of PCT/EP03/06239 filed Jun. 13, 2003.

BACKGROUND OF THE INVENTION

This invention relates to reform rollers and, in particular to rollers for use in internal or external base reforming of can bodies.

Can bodies for containing beverage conventionally comprise a cylindrical side wall and integral base. The base is substantially thicker than the wall ironed side wall and has an upwardly domed central portion and an inner wall extending downwardly from the dome to a stand bead which, in turn, extends upwardly and outwardly to the side wall of the can body. Such beverage can bodies are conventionally made from aluminium alloy or tinplate.

The domed shape of the beverage can body is so designed in order to withstand internal pressure and to resist deformation such as outward bulging of the base. It has been found that by reforming the inner wall of the base either indirectly, by applying an external, or directly using an internal roller, improved dome reversal pressures are obtained. Further advantages of the reformed base profile include greater resistance to deformation, particularly when dropped, and control of overall can height during pasteurisation, handling or transportation.

Although known base reforming generally improves a can's abuse and buckle resistance, there is a great degree of variation in can performance between cans. This variation can lead to unacceptable mean dome depth, dome growth and/or dome reversal pressure. In particular, it has been found that there is instability in the process run with ingoing cans typically showing initially a relatively shallow reform bead in the reform profile and significantly greater dome depth in comparison with the bead and dome depth of cans later in the process run. The process only seems to stabilise after around 50 cans have undergone the reforming process.

EP-0,482,586 describes the use of an additional panel which is provided on the inner wall of the can base between the reform bead and the dome. Whilst this approach is said to improve pressure performance by increasing dome reversal pressure, the additional panel may lead to a loss of can volume due to excessive dome depth. Furthermore it does not address process instability over the course of the reform run.

SUMMARY OF THE INVENTION

This invention seeks to overcome the stability problem and to produce a can body which not only meets the industry specified performance criteria, but also does so on a consistent basis with minimal variation within process runs.

According to the present invention, there is provided an apparatus for reforming the base of a can body, the can body having a substantially cylindrical side wall and an integral base, the base including an outer annular wall, a support portion, an inner wall and a central dome, the apparatus including: one or more reform rollers; an actuator for moving the or each roller from a first position adjacent the base of the can to a second position in which the roller contacts either the outer annular wall or the inner wall of the can base in order to reform at least the inner wall of the can base; and in which the or each reform roller has a textured surface.

In one embodiment, the textured surface has a non-periodic profile with a lay which may be either particulate or multi-directional. Alternatively, a "periodic" profile such as machined grooves, knurling or similar textured profile could be used.

In one embodiment, the textured surface of each roller is a spark eroded finish, a carbide deposited finish or a combination of these. Alternatively, the textured surface may be achieved through blasting with angular irregularly shaped or spherically shaped abrasive particles, such as a sand or aqua blasted finish.

The roller itself is usually formed from a material having a hard surface above 45 HRC (Rockwell hardness scale C). Hardened BD2 (60Rc) steel is a readily available material which will hold the textured surface with acceptable wear rate. Other steels, tool steels and materials such as tungsten carbides, ceramics and even polycrystalline synthetic or cubic boron nitride diamonds could be used, since these too have the required minimum 45 HRC hardness.

The inventor has found that by providing a textured and therefore "rough" finish to the roller, dome growth is consistently controlled to within the typical customer requirement of 0.03"±0.02" (0.762±0.51 mm) maximum permanent (non-recoverable) growth at 90 psi, without the provision of any additional panel (such as that used in EP-0,482,586), or excessive dome depth.

The apparatus is preferably for internal base reforming and each roller has a thickness which is at least 25% of the height of the inner wall.

The roller for the internal base reform may have a first radius which, in use, is at the upper end of the region of contact between the roller and the inner wall and a second radius which is at the lower end of the region of contact, and in which the upper radius is larger than the lower radius.

According to a further aspect of the present invention there is provided a method of reforming the base of a can body having a substantially cylindrical side wall and an integral base, and the base including an outer annular wall, a support portion, an inner wall and a central dome, the method comprising: moving one or more reform rollers from a first position adjacent the base of the can to a second position in which the or each roller contacts either the outer annular wall or the inner wall of the can base in order to reform at least the inner wall of the can base; and controlling the depth of the dome by using reform rollers which have a textured surface.

BRIEF DESCRIPTION OF THE DRAWINGS

Preferred embodiments of the invention will now be described, by way of example only, with reference to the drawings.

DETAILED DESCRIPTION OF THE PREFERRED EMBODIMENTS

Figure 1A:
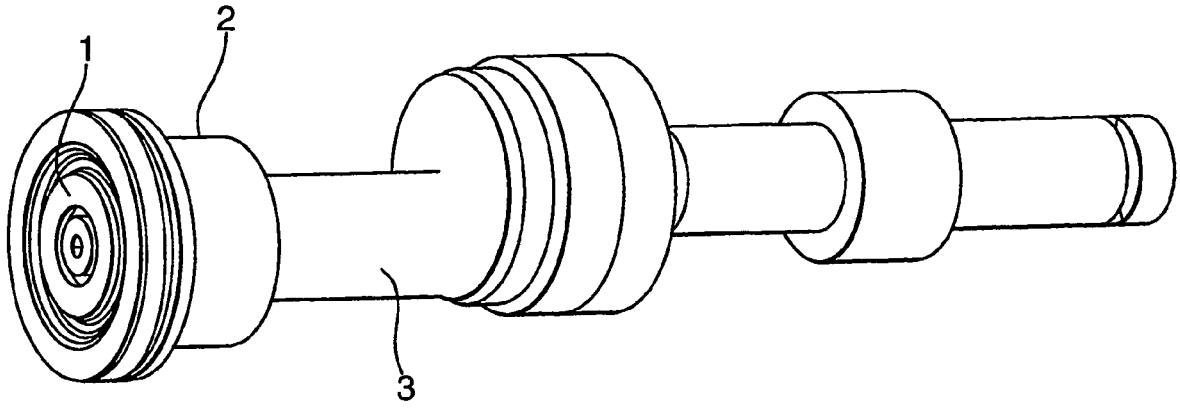
FIG. 1 is a side section of an internal base reforming apparatus.
Figure 1B:
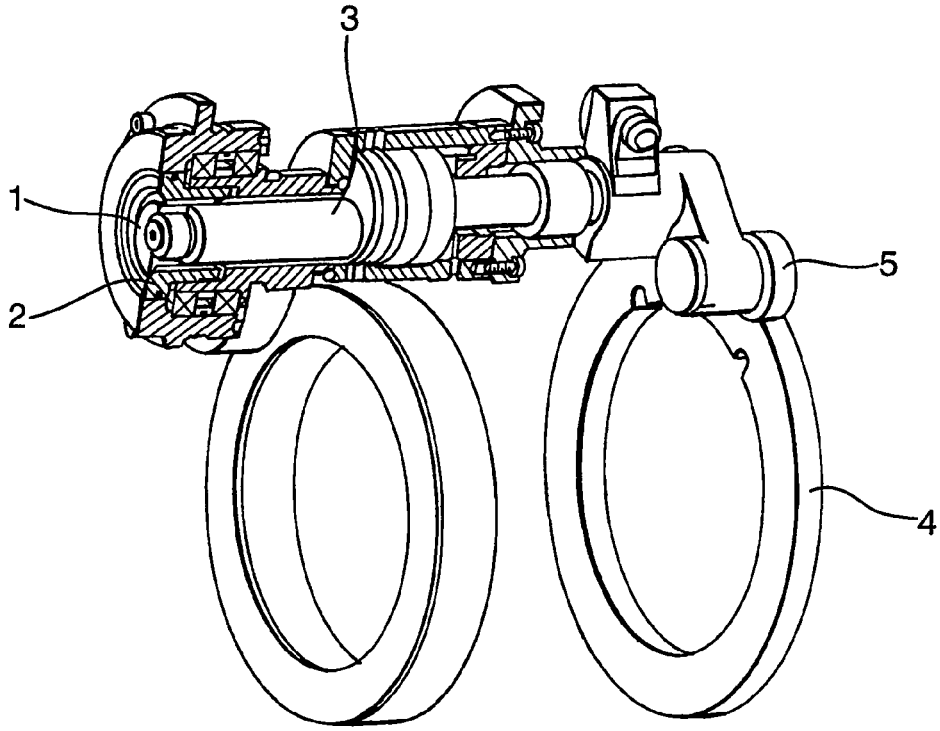

FIGS. 1*a* and 1*b* show side perspective and sectioned view of the reforming apparatus. The reform roller 1 is mounted on a chuck 2. Lateral and rotational movement of the roller, and therefore the profile formed on the internal wall of the can base are dictated by the eccentricity of shaft 3 and the shape of cam 4 which is tracked by cam follower 5.

Figure 2:
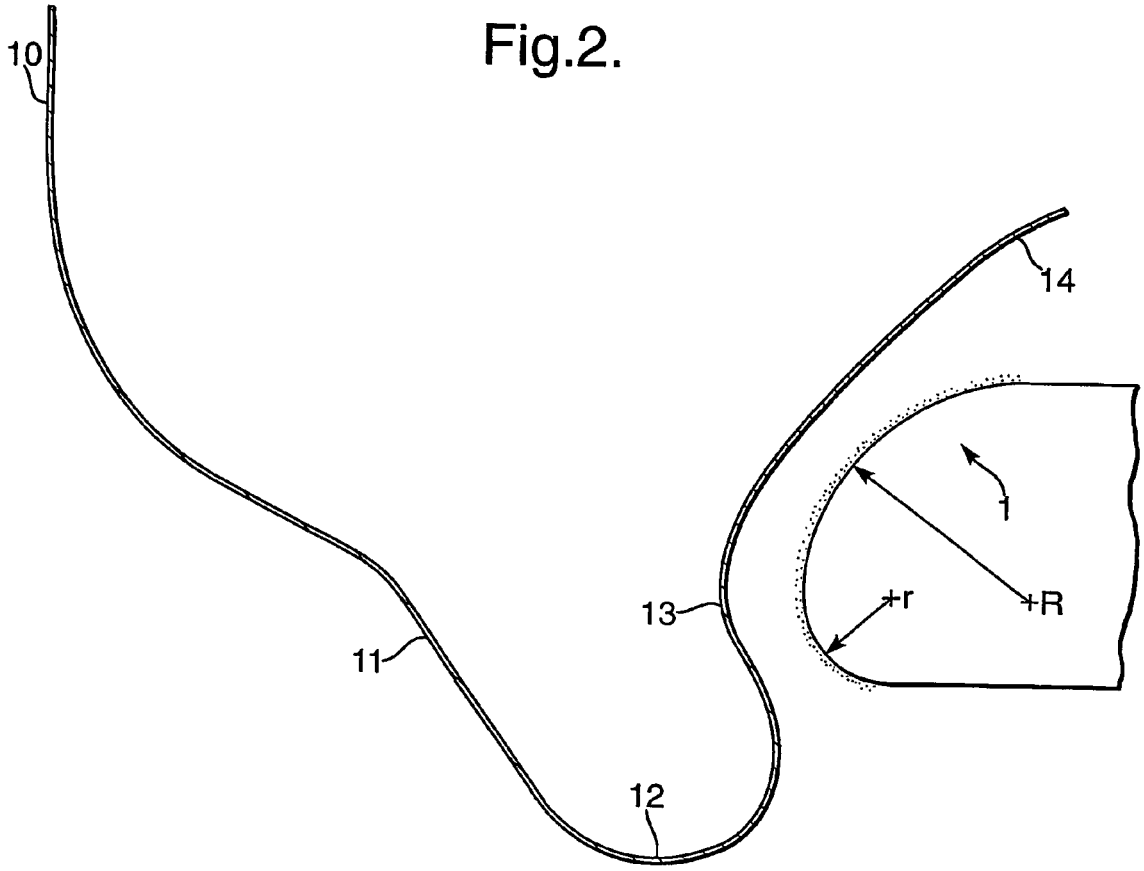
FIG. 2 is a side section of a reform roller according to the invention.

FIG. 2 shows the profile of a reform roller 1 for internal base reforming of a can body. The can body (shown in partial section) has a cylindrical side wall 10, outer wall 11, stand bead 12, inner wall 13 and dome 14. The roller has an upper radius R which, as shown, is adjacent the upper end of the inner wall 13 of the can. The lower radius r of the roller is typically smaller as this has been found to provide the optimum profile of base reform.

Whilst known rollers are typically of the smooth "carbide insert" type, the roller of the present invention is of BD2 hardened (60Rc) tool steel and has a textured surface produced by spark erosion. This finish is typically 25 Rz DIN to 30 Rz DIN as measured with a Talysurf stylus type measuring instrument, where the number units are microns. Alternative finishes such as sand blasting are also possible, although these have a lower roughness value. Finer or coarser finishes in the range of 10 Rz DIN to 60 Rz DIN and 0.8 Ra to 25 Ra are also possible within the scope of the present invention, although the coarser finishes are preferred for the present invention.

Figure 3:
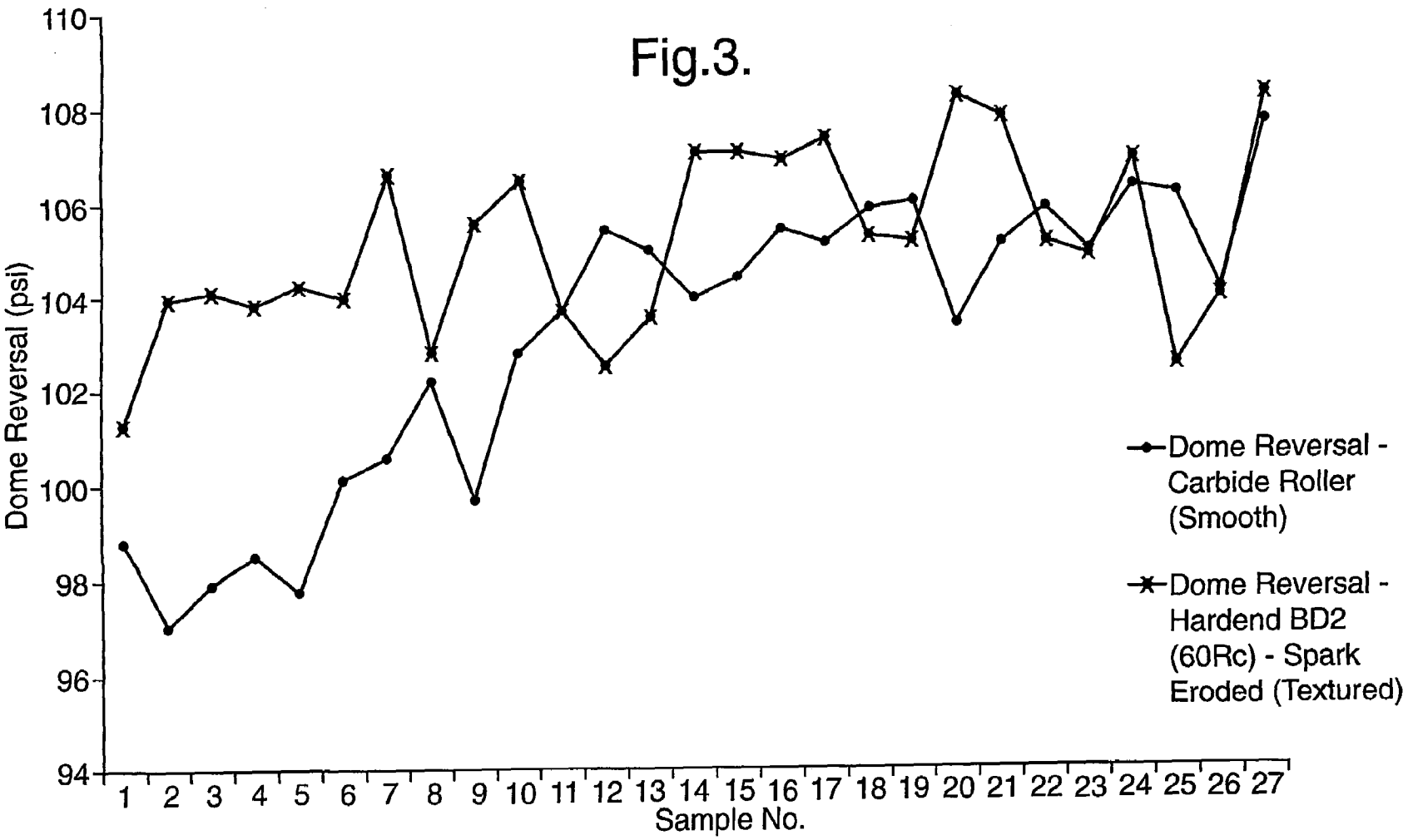
FIG. 3 is a graph of dome reversal for rollers having smooth and textured finishes.

The graph of FIG. 3 represents dome reversal pressures obtained from two batches of 27 aluminium beverage cans after internal base reforming using (i) a smooth carbide roller and (ii) a spark eroded (textured) roller. Whilst all cans reformed using the spark eroded roller consistently achieved dome reversal at pressures higher than the minimum industry specification of 100 psi, cans which were reformed using smooth carbide rollers initially reversed at unacceptably low pressures. Furthermore, it is clear that by reforming the can base with a textured roller rather than a smooth roller, not only is the mean dome reversal pressure higher (105.11 psi and 103.078 psi respectively), but the variation between samples is significantly less. This can readily be seen from FIG. 3, in which for a smooth roller, the minimum dome reversal pressure recorded was 97.02 psi and the maximum was 107.604 psi. In FIG. 3 for the textured roller, on the other hand, the minimum reversal pressure was 101.283 psi and the maximum was 108.192 psi.

Figure 4:
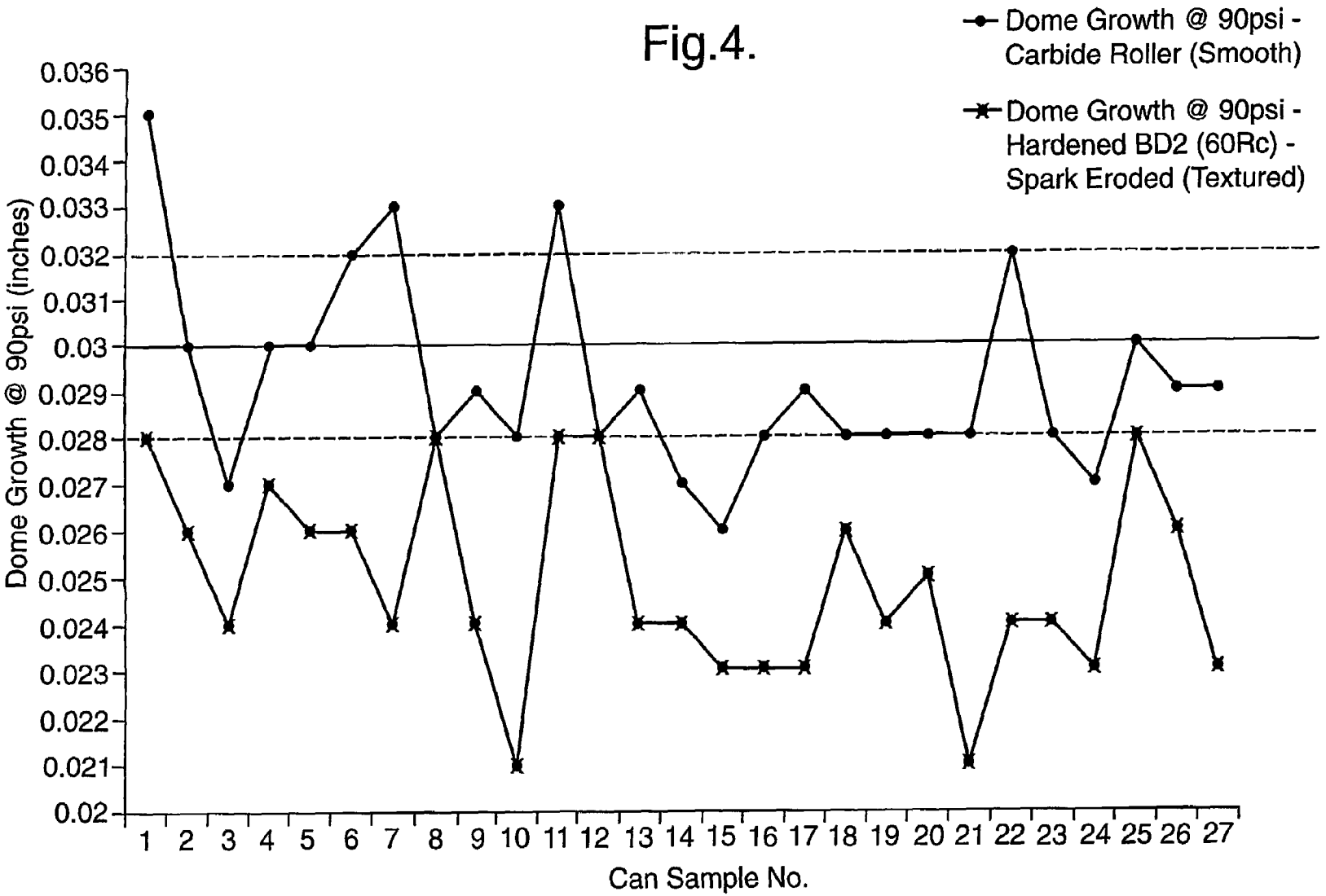
FIG. 4 is a graph of dome growth variation at 90 psi for rollers having smooth and textured finishes.

Any increase in the height of the dome (dome "depth") during base reforming should be kept to a minimum as this will affect the capacity of the can and therefore the volume of beverage which can be contained. One current industry specification for dome growth is 0.03"±0.02" (0.762±0.508 mm) maximum permanent (non-recoverable) growth at 90 psi and there is a desire to limit this further. This specification for maximum dome growth is indicated on the graph of FIG. 4 by a solid line and the tolerances by dotted lines. The dome growth was measured for 27 cans at 90 psi after internal base reforming using (i) a smooth carbide deposited roller and (ii) a spark eroded (textured) roller (see FIG. 4). Dome growth for cans reformed using a textured roller was consistently within the range of tolerances specified above whereas 3 samples reformed with the smooth roller had unacceptably high dome growth and mean dome growth for cans which were reformed using the smooth carbide roller was an order of magnitude greater than those reformed using a textured roller. It is therefore clear that by using a textured roller, dome growth is kept to a minimum without the need for any change in reform profile or the introduction of additional panels during reforming.

Figure 5:
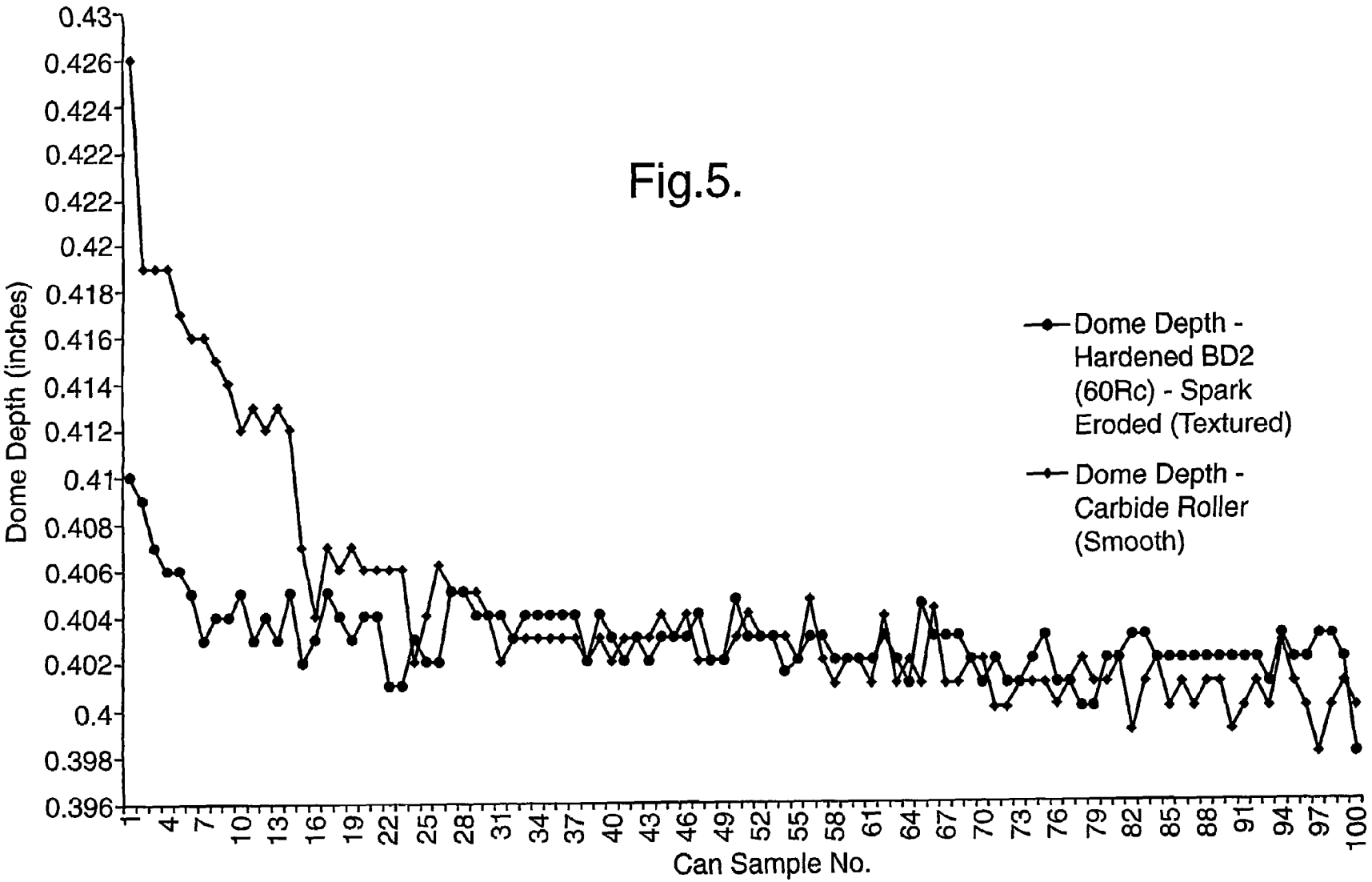
FIG. 5 is a graph of dome depth for rollers having smooth and textured finishes.

A further advantage of the present invention is immediately apparent from the graph of FIG. 5 which shows the actual dome depth obtained for a reform run of 100 cans. Once again, the results for cans reformed using a smooth carbide roller show much greater variability than those for cans reformed using a textured spark eroded roller, particularly for the initial set of cans reformed. In both runs the dome depth settled to around the same level, initial dome depths for cans reformed with a textured roller demonstrate significantly less variability than do those reformed with a smooth roller. In the latter case, it took a significantly greater number of samples before the dome depths settled.

Dome growth, dome reversal pressure and height at which cans failed (by splitting or dome reversal) has been assessed for reforming with differing textured finishes such as wet or dry spark eroded, wet or dry combined spark eroded and carbide deposited, dry carbide deposited, Armourcote, PVO nitride, sand blasted, aqua blasted, grit blasted and combinations of these last three. All cans passed the enamel rater test for lacquer integrity. Whilst performance of all cans which have been reformed using textured rollers is acceptable and is considered to be within the scope of the present invention, greater consistency of results and process stability, in particular dome depth variation, has been found with rougher rollers such as those which have been spark eroded.

Although a preferred embodiment of the invention has been specifically illustrated and described herein, it is to be understood that minor variations may be made in the apparatus without departing from the spirit and scope of the invention, as defined by the appended claims.

The invention claimed is:

1. An apparatus for reforming the base of a can body, the can body having a substantially cylindrical side wall and an integral base, and the base including an outer annular wall, a support portion, an inner wall and a central dome, the apparatus comprising:

one or more reform rollers;

an actuator for moving the or each roller from a first position adjacent the base of the can to a second position in which the roller contacts either the outer annular wall or the inner wall of the can base in order to reform at least the inner wall of the can base;

and in which the or each reform roller has a textured surface.

2. An apparatus according to claim 1, in which the textured surface has a non-periodic profile with a lay which is either particulate or multi-directional.

3. An apparatus according to claim 2, in which the textured surface of each roller is a spark eroded finish, a carbide deposited finish or a combination of these.

4. An apparatus according to claim 2, in which the textured surface of each roller is a sand or aqua blasted finish.

5. An apparatus according to claim 2, in which the apparatus is for internal base reforming and each roller has a thickness which is at least 25% of the height of the inner wall.

6. An apparatus according to claim 1, in which the textured surface of each roller is a spark eroded finish, a carbide deposited finish or a combination of these.

7. An apparatus according to claim 6, in which the apparatus is for internal base reforming and each roller has a thickness which is at least 25% of the height of the inner wall.

8. An apparatus according to claim 1, in which the textured surface of each roller is a sand or aqua blasted finish.

9. An apparatus according to claim 8, in which the apparatus is for internal base reforming and each roller has a thickness which is at least 25% of the height of the inner wall.

10. An apparatus according to claim 1, in which the apparatus is for internal base reforming and each roller has a thickness which is at least 25% of the height of the inner wall.

11. An apparatus according to claim 10, in which the roller has a first radius which, in use, is at the upper end of the region of contact between the roller and the inner wall and a second radius which is at the lower end of the region of contact, and in which the upper radius is larger than the lower radius.

12. A method of reforming the base of a can body, the can body having a substantially cylindrical side wall and an integral base, and the base including an outer annular wall, a support portion, an inner wall and a central dome, the method comprising:

moving one or more reform rollers from a first position adjacent the base of the can to a second position in which the or each roller contacts either the outer annular wall or the inner wall of the can base in order to reform at least the inner wall of the can base; and controlling the depth of the dome by using reform rollers which have a textured surface.

* * * * *